US007562853B2

(12) United States Patent
Mazzola

(10) Patent No.: US 7,562,853 B2
(45) Date of Patent: Jul. 21, 2009

(54) CONTAINER SUPPORT AND MOUNTING BRACKET

(76) Inventor: Christopher Mazzola, 34817 Dryden, Sterling Heights, MI (US) 48312

( * ) Notice: Subject to any disclaimer, the term of this patent is extended or adjusted under 35 U.S.C. 154(b) by 434 days.

(21) Appl. No.: 11/078,450

(22) Filed: Mar. 11, 2005

(65) Prior Publication Data

US 2006/0202096 A1 Sep. 14, 2006

(51) Int. Cl.
*A47G 19/22* (2006.01)

(52) U.S. Cl. ..... 248/311.2; 248/346.11; 248/316.1

(58) Field of Classification Search ..... 248/311.2, 248/346.11, 313, 316.1, 154, 500, 207, 538
See application file for complete search history.

(56) References Cited

U.S. PATENT DOCUMENTS

| | | | | |
|---|---|---|---|---|
| 2,870,983 | A | 1/1959 | Booth | |
| 2,990,152 | A | 6/1961 | Whitney | |
| 3,104,859 | A | 9/1963 | Hoelzel | |
| 3,278,148 | A | 10/1966 | Denaro | |
| 3,650,501 | A * | 3/1972 | Streb | 248/146 |
| 4,071,976 | A | 2/1978 | Chernewski | |
| 4,099,693 | A | 7/1978 | Blann | |
| 4,245,807 | A | 1/1981 | York | |
| 4,278,225 | A * | 7/1981 | Phelps | 248/311.3 |
| 4,333,623 | A * | 6/1982 | May | 248/176.2 |
| 4,433,822 | A | 2/1984 | Caggiano | |
| 4,776,550 | A | 10/1988 | Storey | |
| 4,824,060 | A | 4/1989 | Korda | |
| 4,838,476 | A * | 6/1989 | Rahn | 228/180.1 |
| 5,062,607 | A | 11/1991 | Kisner | |
| 5,133,525 | A | 7/1992 | Good | |
| 5,320,319 | A | 6/1994 | Winger et al. | |
| D353,185 | S * | 12/1994 | Mitchell | D23/206 |
| 5,624,043 | A * | 4/1997 | Baptista | 211/74 |
| 5,649,682 | A | 7/1997 | Martin | |
| 5,758,853 | A * | 6/1998 | Perrin et al. | 248/311.2 |
| 5,975,479 | A * | 11/1999 | Suter | 248/534 |
| 6,003,693 | A * | 12/1999 | Blickenstaff | 211/74 |
| 6,076,636 | A | 6/2000 | Tietge | |
| D496,757 | S * | 9/2004 | Suelzle | D28/61 |
| 6,808,149 | B1 * | 10/2004 | Sendowski et al. | 248/311.3 |

* cited by examiner

*Primary Examiner*—Korie Chan
*Assistant Examiner*—Steven Marsh
(74) *Attorney, Agent, or Firm*—Butzel Long

(57) ABSTRACT

A mounting bracket assembly that is configured for removably supporting storage containers therein at an acute angle with respect to the vertical. The mounting bracket assembly includes a mounting leg for mounting the mounting bracket assembly to a vertical support structure, a support leg, a cross-piece complementary shaped to the upper cross-sectional shape of a storage container, and a support/brace for supporting the bottom of the storage container. The mounting bracket assembly can further include a base from which the mounting leg and support leg extend upwardly.

12 Claims, 3 Drawing Sheets

CONTAINER SUPPORT AND MOUNTING BRACKET

TECHNICAL FIELD

The present invention relates to storage containers that are mounted on a support structure to provide access to articles or materials stored therein. In particular, the present invention is directed to mounting bracket assemblies by which storage containers can be removably supported on various walls, posts and other vertical structures.

BACKGROUND ART

There are many applications which require that articles and/or materials be stored in containers for easy access thereto. For example, various small parts and articles are often stored in storage bins that are removable secured in some manner to a shelf, wall or other support structure. Such storage systems are found in many hardware stores and involve many different configurations.

Similar removable storage bins are used in various home and industrial shops to store various articles and materials.

In general, removable storage devices of the type referred to above allow easy access to remove articles and/or materials after removing the storage containers from their supported positions and containers. After a desired article and/or material is obtained, the storage containers can be easily restored to their stored positions.

In some situations it is convenient to provide a portable storage container which can be carried to a work site for access to the articles stored therein. For example, many construction workers, carpenters, servicemen, repairmen, etc. use plastic buckets to store and transport tools, hardware, etc. to work sites. While this use of plastic buckets is convenient, problems can arise as to organizing and storing the buckets in a work vehicle or even at a storage site. If the buckets are left on the floor of a work vehicle they can slide around while the vehicle is moving. Moreover, they can be in the way when a worker has to enter a work vehicle.

While such buckets can be stored on shelves provided in a work vehicle or otherwise hung by handles on the inner side walls of work vehicles or hung on shelf structures, such manner of storing the article or material-filled buckets is not desirable, because it may be difficult to remove or replace articles in the buckets if one merely wants to remove or replace an article or material therefrom without having to remove the buckets from their storage positions. The shelf structure and bucket handles can interfere with the removing or replacement of articles or materials form/into the buckets.

There are numerous brackets which are designed to support buckets and similar cylindrical articles as exemplified by U.S. Pat. No. 2,870,983 to Booth, U.S. Pat. No. 2,990,152 to Whitney, U.S. Pat. No. 3,104,859 to Hoelzel, U.S. Pat. No. 3,278,148 to Denaro, U.S. Pat. No. 4,071,976 to Chernewski, U.S. Pat. No. 4,099,693 to Blann, U.S. Pat. No. 4,245,807 to York, U.S. Pat. No. 4,433,822 to Caggiano, U.S. Pat. No. 4,776,550 to Storey, U.S. Pat. No. 4,824,060 to Korda, U.S. Pat. No. 5,062,607 to Kisner, U.S. Pat. No. 5,133,525 to Good, U.S. Pat. No. 5,320,319 to Winger, et al., U.S. Pat. No. 5,649,682 to Martin and U.S. Pat. No. 6,076,636 to Tietge.

The present invention provides mounting bracket assemblies by which storage containers can be removably supported on various walls, posts and other vertical structures in a manner that allows easy access to articles and/or materials in the containers in their stored positions.

DISCLOSURE OF THE INVENTION

According to various features, characteristics and embodiments of the present invention which will become apparent as the description thereof proceeds, the present invention provides a mounting bracket assembly for removably supporting a storage container thereon, the mounting bracket assembly including:

an elongate rectangular base having first and second opposite ends;

a mounting leg extending upward from the first end of the elongate rectangular base;

a support leg extending upward from the second end of the elongate rectangular base, the support leg including a free end which is distal from the elongate rectangular base;

a cross-piece coupled to the support leg near the free end and having a shape which is complimentary to a cross-sectional shape of a storage container to be supported by the mounting bracket assembly; and a support/brace member extending between the mounting leg and at least one of the base member and the support leg, the cross-piece and the support/brace member being aligned to support a storage container at an acute angle with respect to the mounting leg.

The present invention also provides a mounting bracket assembly for removably supporting a storage container thereon, the mounting bracket assembly including:

a mounting leg having a first end and a free second end;

a support leg extending upward from the first end of mounting leg, the support leg including a free end which is distal from the mounting leg;

a cross-piece coupled to the support leg near the free end and having a shape which is complimentary to a cross-sectional shape of a storage container to be supported by the mounting bracket assembly; and a support/brace member extending between the mounting leg and the support leg, the cross-piece and the support/brace member being aligned to support a storage container at an acute angle with respect to the mounting leg.

The present invention further provides a storage container in combination with a mounting bracket assembly for removably supporting the storage container thereon, the storage container including a bottom, at least one side wall and a top, the mounting bracket assembly comprising:

an elongate rectangular base having first and second opposite ends;

a mounting leg extending upward from the first end of the elongate rectangular base;

a support leg extending upward from the second end of the elongate rectangular base, the support leg including a free end which is distal from the elongate rectangular base;

a cross-piece coupled to the support leg near the free end and having a shape which is complimentary to a cross-sectional shape of the storage container; and a support/brace member extending between the mounting leg and at least one of the base member and the support leg, the cross-piece and the support/brace member being aligned to support the storage container at an acute angle with respect to the mounting leg.

BRIEF DESCRIPTION OF DRAWINGS

The present invention will be described with reference to the attached drawings which are given as non-limiting examples only, in which.

BEST MODE FOR CARRYING OUT THE INVENTION

Figure 1:
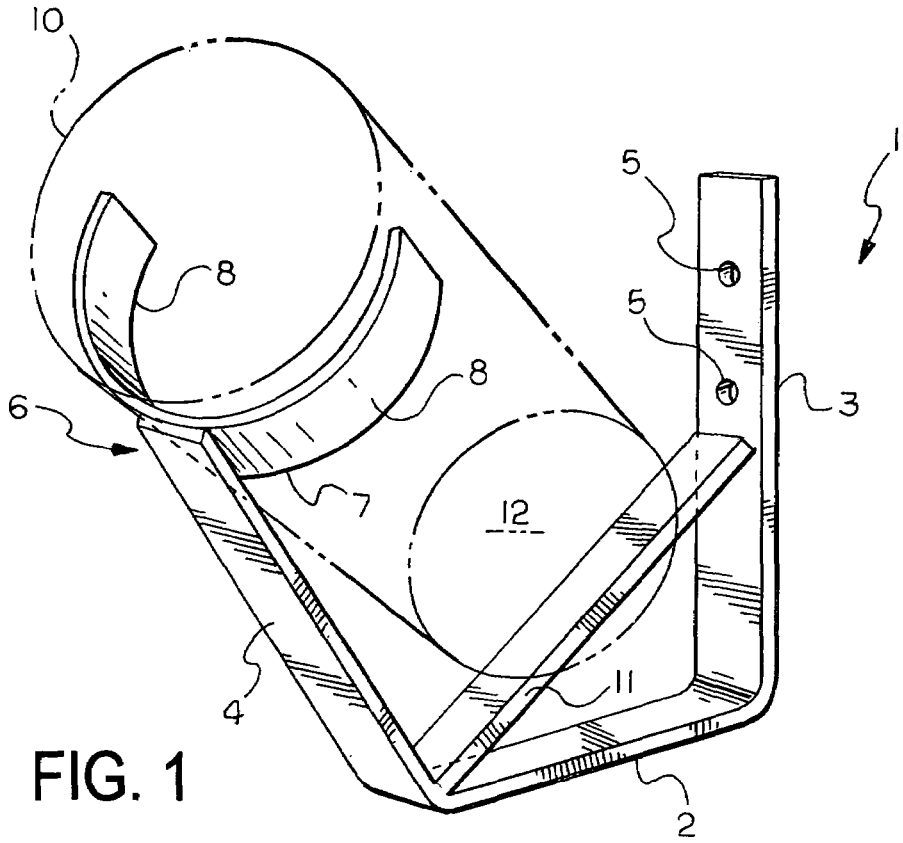
FIG. 1 is a side perspective view of a mounting bracket assembly according to one embodiment of the present invention.

The present invention is directed to mounting bracket assemblies by which storage containers can be removably supported on various walls, posts and other vertical structures in a manner that allows easy access to articles and/or materials in the containers in their stored positions. The mounting bracket assemblies of the present invention are configured to receive and support a storage container at an inclined angle so that articles and/or material within the storage containers can be easily accessed from the open top of the storage container. The angle at which the storage containers can be supported is dependent upon the configuration of the individual mounting bracket assemblies, it being readily apparent from the description that follows that the angle at which any particular storage container is supported can be predetermined by proper configuration of the mounting bracket assembly. Generally storage angles of from about 25° to 70° (from the horizontal) are suitable for purposes of the present invention, although acute angles of from greater than about 0° up to 90° are possible. In some instances a row, column or other configuration or group of a plurality of containers which are supported by the mounting bracket assemblies of the present invention can be inclined at different angles.

The containers that are supported on the mounting bracket assemblies of the present invention can be made of any conventional material, including plastic materials, metals, wood, fiber, cardboard, etc. Containers that are made of transparent or semi-transparent materials or translucent materials in whole or in part will enable visual determination of the contents therein through the sides. The containers may be cylindrically shaped or be elongate with other than a circular cross-sectional shape, including square, rectangular, oval, elliptical, polygonal, etc. The containers can also be tapered if desired. Accordingly to one embodiment of the present invention, the mounting bracket assemblies were configured to receive and support standard 5gallon plastic buckets. All types of containers including baskets can be supported on the mounting bracket assemblies of the present invention.

The storage containers can have lids or other closures as desired that can be removed or opened in any convenient manner including being openable by hinged, pivoting, sliding or rotational movement or by pulling the lids or closures off the tops of the containers.

According to one embodiment of the present invention the mounting bracket assemblies include a base having two legs extending from opposite sides. One of the legs is a mounting leg that includes two or more through-holes through which suitable mechanical fasteners can be used to secure the mounting leg to a support such as a wall, post or other desired vertical surface. Alternatively, the free end of the mounting leg can be bent or hooked shape to hang the mounting bracket assembly to a support structure. The other leg is a support leg that includes a free or distal end to which a cross-piece is secured. The cross-piece is contoured, e.g. curved, to be complementary to the cross-sectional shape of a storage container to be supported by the mounting bracket assembly. The angle of the support leg with respect to the mounting leg determines the angle (relative to the vertical surface upon which the mounting bracket is secured) at which the storage container is supported. An additional support/brace member is provided which is secured between the mounting leg and the base (or support leg). This support/brace member is provided at an angle that so that the bottom of a storage container supported by the mounting bracket assembly rests substantially flatly on the support/brace member.

According to another embodiment of the present invention the mounting leg and support leg intersect and the support/brace member extends between these two legs.

The base and leg members can be made from an integral structural or pieces that are coupled together by any convenient means such as mechanical fasteners or by welding, bolting, gluing, epoxying, etc. The elements of the mounting bracket assembly can be made from metal, plastic materials, wood, or any suitable material that is strong enough to support desired storage containers.

The exact shape of the mounting bracket assemblies of the present invention can be varied for aesthetic purposes although the support/brace member and cross-piece need to be positioned and aligned to support a storage container at a desired angle.

The manner in which the mounting bracket assembly receives and supports a storage container allows the storage to be easily positioned on the mounting bracket assembly and removed from the mounting bracket assembly.

FIG. 1 is a side perspective view of a mounting bracket assembly according to one embodiment of the present invention. The mounting bracket assembly generally identified by reference numeral 1 in FIG. 1 includes a base 2 having two legs 3 and 4 extending from opposite sides. One of the legs is a mounting leg 3 that includes two or more through-holes 5 through which suitable mechanical fasteners (not shown) can be used to secure the mounting leg 3 to a support such as a wall, post or other desired vertical surface. The other leg is a support leg 4 that includes a free or distal end 6 to which a cross-piece is secured 7. The cross-piece 7 is configured to receive and support the upper portion of a storage container 10 (shown in phantom) thereon. The cross-piece 7 includes two arm portions 8 which extend from a central portion at which the cross-piece 7 is attached to the free or distal end 6 of support leg 4.

A support/brace member 11 is secured between the mounting leg 3 and the base 2 as depicted in FIG. 1. The support/brace member 11 is provided at an angle that so that the bottom 12 of a storage container 10 supported by the mounting bracket assembly 1 rests substantially flatly on the support/brace member 11.

Figure 5:
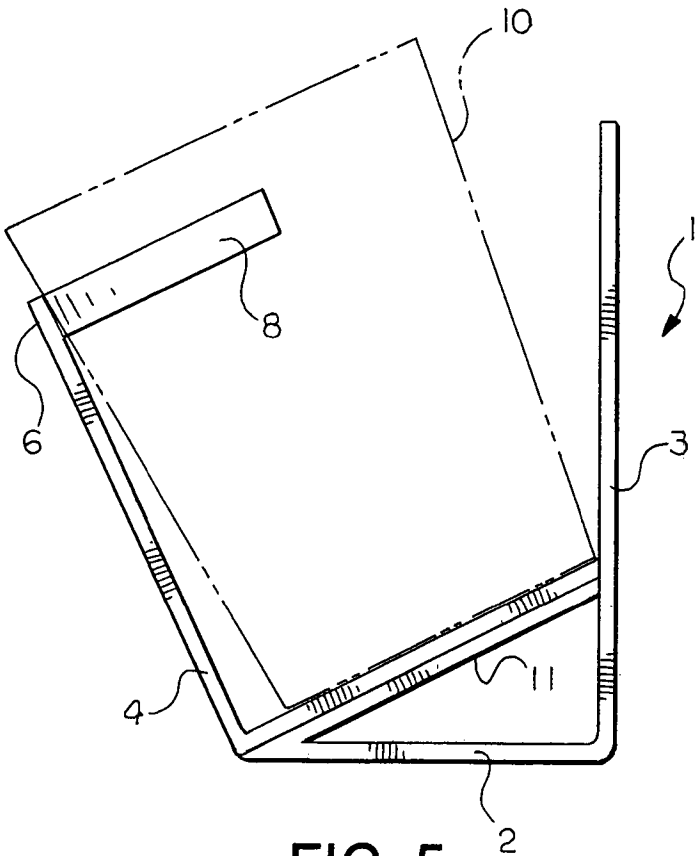
FIG. 5 is a side view of the mounting bracket assembly according to another embodiment of the present invention.

The base 2 mounting leg 3 and support leg 4 are depicted in FIG. 1 as being an integral continuous structure with the support/brace member 11 attached thereto. It is also possible to form the mounting leg 3, base 2 and support/brace member 11 as an integral continuous structure and secure thereto the support leg 4. Such an arrangement is depicted in FIG. 5. It is to be understood that the exact shape of the mounting bracket assemblies of the present invention can be varied from the non-limiting examples depicted in the drawings as long as the support/brace member 11 and cross-piece 7 are positioned to support a storage container 10 thereon at a desired angle. Moreover, it is to be understood that the support/brace member 11 and cross-piece 7 can be separate elements of the mounting bracket assembly 1 and attached to the other elements, including the leg members. Alternatively, the support/brace member 11 and cross-piece 7 can be integrally formed with each other and/or other elements of the of the mounting bracket assembly 1.

Figure 2:
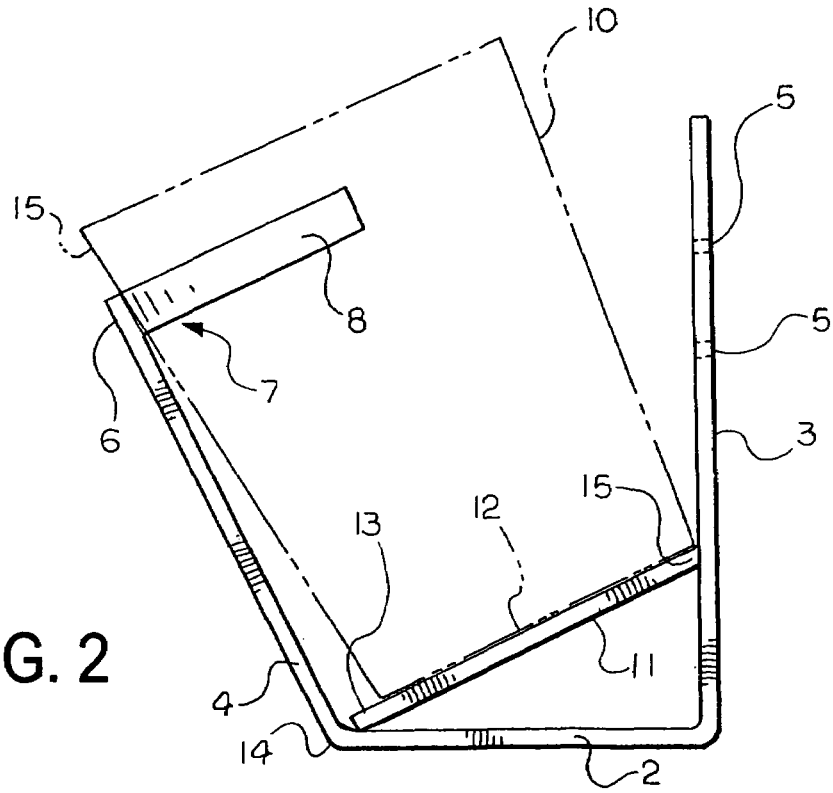
FIG. 2 is a side view of the mounting bracket assembly of FIG. 1.

FIG. 2 is a side view of the mounting bracket assembly of FIG. 1. In FIG. 2 the base 2, mounting leg 3 and support leg 4 are depicted as being an integral continuous structure which can be molded or bent in the illustrated configuration. As depicted, the support leg 4 is perpendicular to the support/brace member 11 and support leg 4 is inclined outwardly (from the vertical) at an acute angle which can be chosen as the angle at which supported storage container 10 is supported. The support/brace member 11 has one end 13 which is located at the junction 14 between the base 2 and support leg 4 and an opposite end 15 which is attached to the side of the mounting leg 3 at a position that which aligns the support/brace member 11 at an angle that flatly supports the bottom 12 of a storage container 10 supported on the mounting bracket assembly 1.

The cross-piece 7 is attached at or near the free or distal end 6 of support leg 4. The arms 8 (one shown) of the cross-piece 7 extend around the circumference of storage container 10 enough to prevent the storage container 10 from falling sideways off the mounting bracket assembly 1. As shown in FIG. 2 the arms 8 of the cross-piece 7 each extend along about 25% of the circumference of the supported storage container 10. It is understood that the arms 8 could extend around the entire circumference of the storage container 10. However, by limiting the length of arms 8 so that they extend to no more the 25% of the circumference of the storage container 10, the storage container 10 can be easily be lifted off the mounting bracket assembly 1. By allowing the storage container 10 to be easily removed from the mounting bracket assembly 1, users can remove and carry the storage container(s) 10 directly to a work site where the articles or materials in the storage container(s) 10 can be made available. It is also possible to have the free ends of the arms 8 extend outwardly from or beyond the cross-sectional shape of a storage container 10 if desired. An example of the latter would include a U-shaped cross-piece member for receiving and supporting a cylindrical shaped container.

As shown, the arms 8 of the cross-piece 7 are located a short distance below the top 16 of the storage container 10. In the case where the storage container 10 includes additional structural features near the top 16 (as is common on standard 5 gallon plastic buckets), the arms 8 of the cross-piece 7 can be positioned below such structure. The height of the arms 8 of the cross-piece 7 are determined by the length of support leg 4 and the point at which the cross-piece 7 is attached to support leg 4. In the case where a storage container 10 has a handle attached near the top 16 thereof, the arms 8 of the cross-piece 7 can be positioned to be below the handle.

Figure 3:
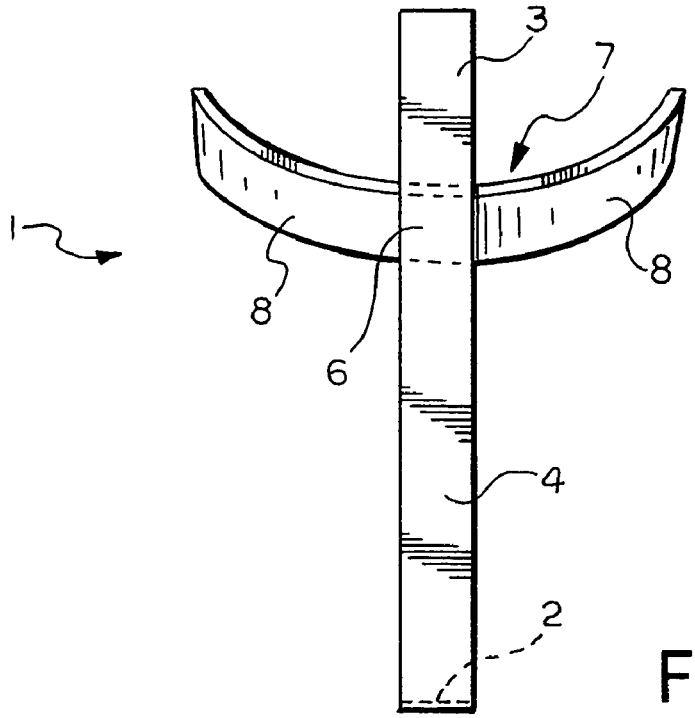
FIG. 3 is a front view of the mounting bracket assembly of FIG. 1.

FIG. 3 is a front view of the mounting bracket assembly of FIG. 1. As shown in FIG. 3, the cross-piece 7 is mounted near the top 6 of support leg 4 so that the arms 8 extend substantially equal distance from support leg 4. The cross-piece 7 can be secured to support leg 4 by any suitable mechanical fastening means or means such as welding, bolting, gluing, epoxying, etc.

Figure 4:
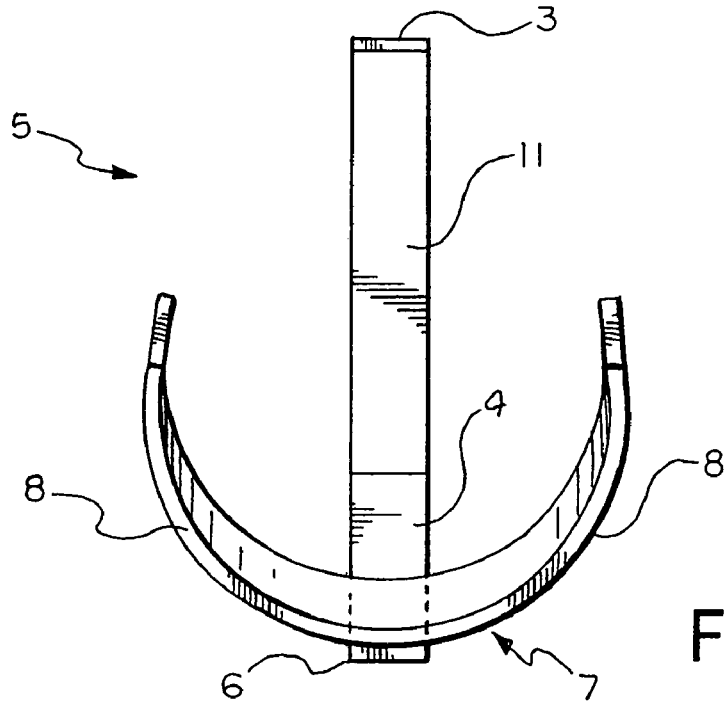
FIG. 4 is a top view of the mounting bracket assembly of FIG. 1.

FIG. 4 is a top view of the mounting bracket assembly of FIG. 1. FIG. 4 depicts how the mounting leg 3, support leg 4 and support/brace member 11 are linearly aligned. According to one embodiment of the present invention the base 2, mounting leg 3, support leg 4, support/brace member 11 and cross-piece 7 are each manufactured from metal stock having a rectangular cross-sectional shape. The metal stock and be cut to length, bent into shape and welded to form the mounting bracket assembly. It is also possible to make the mounting bracket assembly from materials such as plastic materials that can be molded or other materials such as wood, alloys, etc. that can be worked of configured using known methods.

Figure 6:
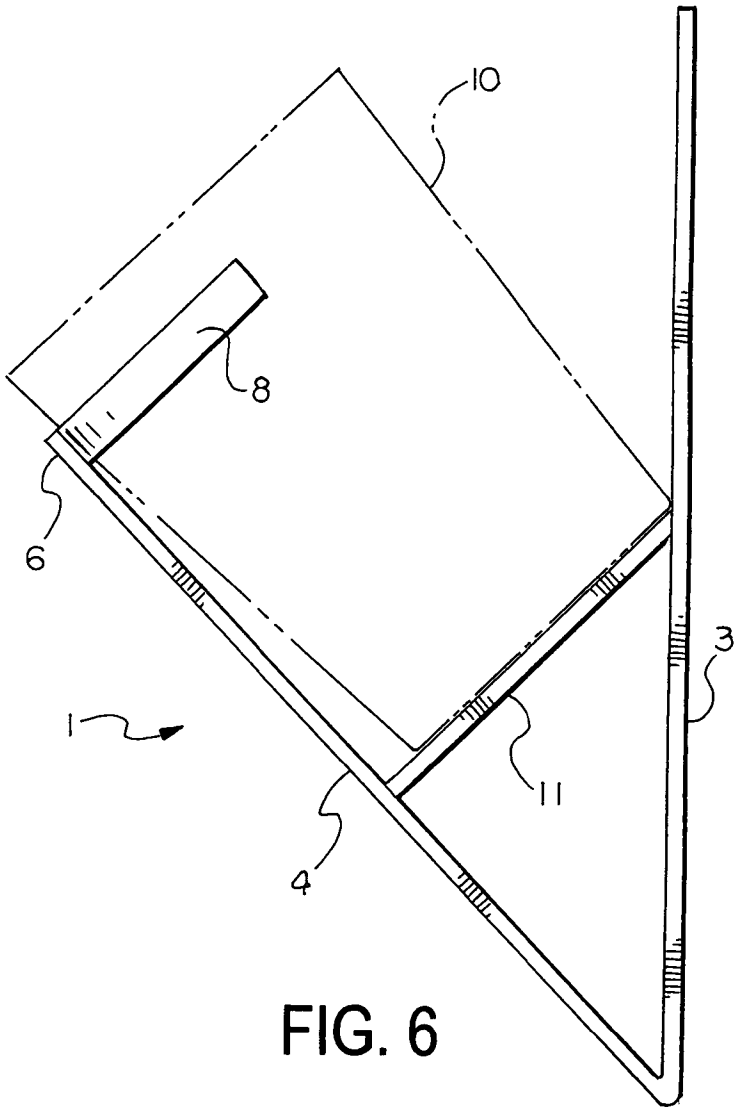
FIG. 6 is a side view of the mounting bracket assembly according to another embodiment of the present invention.

FIG. 6 is a side view of the mounting bracket assembly according to another embodiment of the present invention. The mounting bracket assembly 1 depicted in FIG. 6 does not include a separate base as in the case of the mounting bracket assembly depicted in FIGS. 1-5. In FIG. 6, the mounting leg 3 and support leg 4 which supports the cross-piece 7 are continuous with one another at their junction 17. FIG. 6 provides another example of how the configuration of the mounting bracket assemblies of the present invention can vary while. maintaining the angle of support leg 4 and support/brace member 11.

It is noted that the support/brace member 11 can include a wider center area if desired to support the bottom of a storage container thereon and a rim or partial rim to keep a storage container positioned thereon so as not to slide on the support/brace member 11.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A storage container having a substantially flat bottom in combination with a mounting bracket assembly for removably supporting the storage container thereon, the storage container including a substantially flat bottom, at least one side wall and a top, the mounting bracket assembly comprising:

an elongate rectangular base having first and second opposite ends;

a mounting leg extending upward from the first end of the elongate rectangular base;

a support leg extending upward from the second end of the elongate rectangular base, the support leg including a free end which is distal from the elongate rectangular base;

a cross-piece coupled to the support leg near the free end and having a shape which is complimentary to a cross-sectional shape of the storage container; and a single support/brace member having opposite ends and extending between the mounting end and at least one of the elongate rectangular base and the support leg with one of the opposite ends being stationarily fixed in position with respect to the mounting leg and the other opposite end being stationarily fixed in position with respect to the at least one of the elongate rectangular base and the support leg, the cross-piece and the support/brace member being aligned to support the storage container at an acute angle with respect to the mounting leg with the cross-piece contacting a side portion of the container and the support/brace contacting the substantially flat bottom of the container.

2. A mounting bracket assembly for removably supporting a storage container thereon according to claim 1 wherein the cross-piece is coupled to the support leg at a middle portion of the cross-piece.

3. A mounting bracket assembly for removably supporting a storage container thereon according to claim 2, wherein the cross-piece includes two arms which have a total length which is equal to or less than the circumference of a storage container to be supported thereon.

4. A mounting bracket assembly for removably supporting a storage container thereon according to claim 3, wherein the cross-piece has a curved shape.

5. A mounting bracket assembly for removably supporting a storage container thereon according to claim 4, wherein the cross-piece has a semi-circular shape.

6. A mounting bracket assembly for removably supporting a storage container thereon according to claim 1 wherein the at least two of the base, mounting leg, support leg and support/brace member comprise a single continuous integral structure.

7. A mounting bracket assembly for removably supporting a storage container thereon according to claim 1 wherein the support/brace member comprises a rectangular structure.

8. A mounting bracket assembly for removably supporting a storage container thereon according to claim 1 wherein the mounting leg includes a plurality of through-holes therein.

9. The combination of claim 1, wherein the storage container comprises a cylindrical wall.

10. The combination of claim 9, wherein the storage container comprises a 5 gallon bucket.

11. The combination of claim 1, wherein the cross-piece includes two arms which have a total length which is equal to or less than a circumference of the storage container.

12. The combination of claim 1, wherein the mounting bracket assembly is made from one of metal, plastic and wood and the storage container is made from one of plastic, metal, wood, fiber and cardboard.

* * * * *